US005575467A

United States Patent [19]

Williams

[11] Patent Number: 5,575,467

[45] Date of Patent: Nov. 19, 1996

[54] DYNAMIC FORCE PAPER SEPARATOR

[75] Inventor: Scott S. Williams, Lexington, Ky.

[73] Assignee: Lexmark International, Inc., Lexington, Ky.

[21] Appl. No.: 533,198

[22] Filed: Sep. 25, 1995

[51] Int. Cl.[6] ..... B65H 3/52

[52] U.S. Cl. ..... 271/122; 271/125

[58] Field of Search ..... 271/122, 117, 271/125, 10.09, 10.11, 10.13

[56] References Cited

U.S. PATENT DOCUMENTS

| | | | |
|---|---|---|---|
| 3,306,491 | 2/1967 | Eisner et al. | 221/41 |
| 4,368,881 | 1/1983 | Landa | 271/122 |
| 4,546,963 | 10/1985 | Dinnissen | 271/35 |
| 4,627,607 | 12/1986 | Ishii | 271/122 |
| 4,801,134 | 1/1989 | Yokoyama et al. | 271/122 |
| 4,925,177 | 5/1990 | Nakamura et al. | 271/110 |
| 5,016,866 | 5/1991 | Takahashi | 271/122 |
| 5,312,098 | 5/1994 | Inoue | 271/122 |
| 5,377,970 | 1/1995 | Kikuchi | 271/121 |

*Primary Examiner*—David H. Bollinger
*Attorney, Agent, or Firm*—John A. Brady

[57] ABSTRACT

Paper from a bin (1) enters a nip between a drive roller (13) and a torque-limited restraint roller (15). The drive roller is mounted on a pivoted bracket (7), having a gear train of a drive gear (9) and a driven gear (11). The drive roller is coaxial with the driven gear and turns with the driven gear. The bracket is self-compensating in that it automatically applies normal force to the drive roller sufficient to permit movement of paper (3). When the paper is more than one sheet, sufficient force is automatically applied to the drive roller to move the top sheet while the restraint roller holds or moves backward the bottom sheet.

2 Claims, 1 Drawing Sheet

DYNAMIC FORCE PAPER SEPARATOR

TECHNICAL FIELD

This invention relates to the feeding of paper and other media with separation of papers moving together to assure feeding of individual sheets.

BACKGROUND OF THE INVENTION

This invention employs in part an assembly which has been employed in paper feeding but not for paper separation. That assembly is a pivoted gear train on a bracket having a driven gear at one end and a drive gear at the other end, with the direction of rotation of the drive gear being that to move the bracket toward a stack of papers to be feed. U.S. Pat. No. 3,306,491 to Eisner et al and U.S. Pat. No. 4,925,177 to Nakamura et al show such a paper feed, although without any apparent recognition that the force of the feed roller is dynamic in that rotation of the feed roller automatically relieves downward form from the driven gear. U.S. patent application Ser. No. 08/406,233 of Padget et al, assigned to the assignee of this invention, is directed to a paper picker, not a separator, in which the dynamic forces of the gear train employed are those employed in this invention.

U.S. Pat. No. 5,377,970 to Kikachi is a sheet separator having much of the structure of this invention with the drive roller driven as in this invention. However, the drive roller is opposite a fixed surface, not a roller and the patent exhibits no apparent recognition that the force of the feed roller is dynamic. U.S. Pat. No. 5,312,098 to Inoue is a sheet separator having much of the structure of this invention but the drive roller is driven in the opposite direction, which reverses any dynamic pressure effects with respect to this invention and therefore is fundamentally different from this invention. U.S. Pat. No. 4,368,881 to Landa is a separating paper feeder having a nip of a drive roller and an opposing roller, as does this invention, with the reverse force of the opposing roller being self adjusting by use of a coil-spring clutch. This invention employs self adjusting nip force achieved by a gear train mounted in a bracket. U.S. Pat. No. 4,546,963 to Dinnissen employs pinch rollers for separation with one roller mounted on a bracket. However, since that pinch roller is not driven through a drive train, the dynamic forces of this invention could not occur.

DISCLOSURE OF THE INVENTION

In accordance with this invention, separation of paper or other media occurs at the nip of a feed roller and a resistance roller. The feed roller applies force in the sheet feed direction. The resistance roller can be either torque limited and nondriven or torque limited and driven in the reverse direction. The drive roller is mounted on a bracket in a gear train and the bracket is pivoted around the drive gear on said bracket. The drive gear is rotated in a direction to pivot the bracket toward the nip. Spaced past the nip is a drive member operating to move the paper at a speed greater than that at which the drive roller in the separating nip is operated. When this begins to control paper movement, the pinch force at the nip is automatically relieved and the paper is free to move unconstrained by the separating nip.

BRIEF DESCRIPTION OF THE DRAWING

The details of this invention wile be described in connection with the accompanying drawing, which is an illustrative side view of a sheet feeder in accordance with this invention.

BEST MODE FOR CARRYING OUT THE INVENTION

Figure 1:
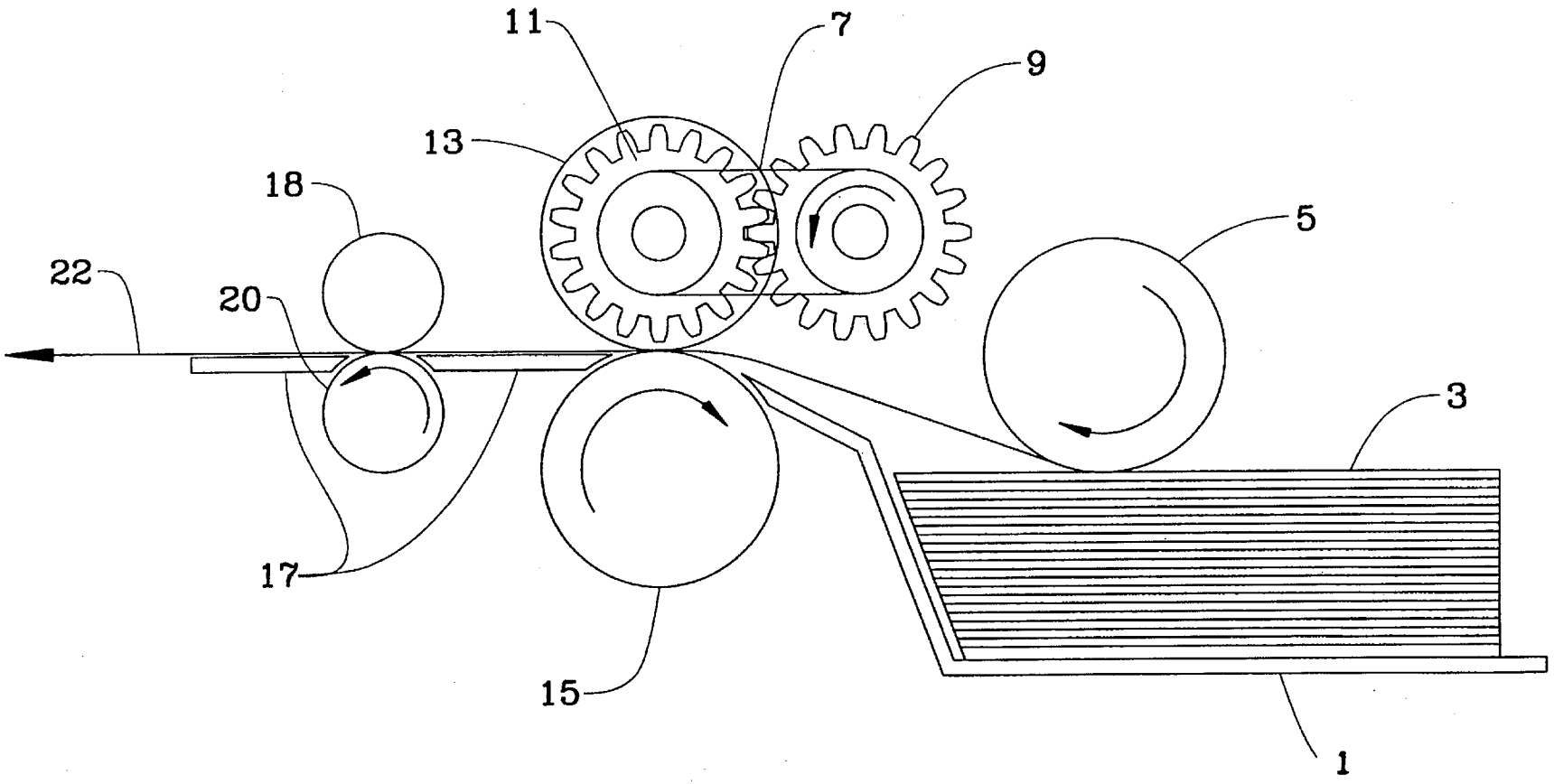

As shown in the drawing, a bin 1 holds a stack of paper 3 or other media sheets. A top feed roller 5, shown as a pick roller, initiates the feed of paper 3. Pick roller 5 may be any device which moves paper and then disengages. Paper 3 initially moved by pick roller 5, may stick together and be more than one sheet in thickness. The remaining mechanism shown feeds only a single sheet, thereby separating the lower sheets for subsequent use.

Bracket 7 holds a drive gear 9 meshed with a driven gear 11. Bracket 7 is mounted so as to be freely rotatable about gear 9. Gear 9 is driven for paper feed in the counterclockwise direction of the drawing. That direction of rotation applies a downward force on gear 11 until rotation of gear 11 relieves that force. The downward force on gear 11 applies a counterclockwise rotation to bracket 7 since gear 11 is mounted on bracket 7. Drive roller 13 is slightly larger than gear 11 and is mounted coaxial with and to turn with gear 11. Drive roller 13 is cantilevered or otherwise spaced from gear 11. Drive roller 13 has a frictional surface which does not slip on paper 3 in normal operation. Accordingly, drive roller 13 tends to move the top sheet of paper 3 away from bin 1, which is the paper feed direction.

Restraint roller 15 under drive roller 13 forms a nip with drive roller 13. Restraint roller 15 has a surface coefficient of friction greater than the coefficient of friction between sheets of paper 3. Restraint roller 15 is designed to resist any movement below a predetermined torque on roller 15 or may be driven to turn clockwise until receiving a predetermined torque in the opposite direction. At torques greater than the predetermined torque, roller 15 rotates counterclockwise (termed torque limited).

Paper exiting separating rollers 13 and 15 passes along a guide surface 17 to enter the nip of sheet feed rollers 18 and 20. One or both of these rollers 18 and 20 are driven at a surface speed slightly faster than that of driven roller 13 of the separator in the paper feed direction, shown by arrow 22.

In operation excellent sheet separation to a single sheet and reliable, low power paper feeding is realized. Roller 13 applies a force at the nip of rollers 13 and 15 sufficient to overcome the torque of roller 15. The coefficient of friction of restraint roller 13 is greater than that of paper to paper stacked in the nip of rollers 13 and 15. Assuming two or more sheets 3 enter the rotating nip of roller 13 and 15, the sheet facing roller 13 will move when roller 13 moves, while the torque acting on roller 15 as well as the higher coefficient of friction of roller 15 will stop the lower sheet and separation will occur between the sheets. If roller 15 is torque limited and driven clockwise, it will move the lower sheet back toward bin 1.

When the paper 3 enters the nip of rollers 18 and 20, which accelerate the movement of paper 3 somewhat, downward pressure of roller 13 is automatically relieved.

The nip force of rollers 13 and 15 is defined by the precise amount required to overcome the force required to restrain the lower paper 3. This force relationship is maintained at all times without sensitivity to manufacturing tolerances. Drag in the downstream paper path can produce problems with velocity control, wear, alignment, and release shock resulting in print quality defects. With the automatic release of nip pressure of this invention, the drag is greatly reduced.

Since the nip force is generated dynamically, there is no need for spring loading of the nip or critical manufacturing tolerance to maintain physical locations such a center distances, diameter, and other factors for force at the nip. No added mechanism is need to open the nip. The mechanism can operate with lower resistant forces, resulting in lower power consumption.

Since nip force is generated dynamically, there is no tendency to flatten the rollers 13 and 15 due to compression set if the product remains idle for a long period.

Since the seperator roller 13 is carried on a pivoted bracket 7, the nip is free to open and accept thick media without affecting basic operation of the separator, or changing operating nip forces.

Relationships of the foregoing to facilitate specific designs are as follows:

1) The normal force of roller 13 prior to any rotation is the torque on gear 9 divided by the distance between the axis of rotation of gear 9 and gear 13 (that distance being effectively a lever arm). The final operating force normal is governed by the magnitude of torque limiting designed into the restraint roll while feeding a single sheet.

2) The grip force for moving sheets 3 tangential to the nip of rollers 13 and 15 is a function of the normal force at the nip and the coefficient of friction of the roller 13 surface.

3) The drive force of roller 13 in the sheet feed direction is the torque on drive gear 9 divided by the effective gear radius of that gear, multiplied by the effective gear radius of the gear it drives, gear 11, divided by the radius of the coaxial drive roller, roller 13.

4) In all cases, the coefficient of friction of paper 3 to paper 3 must be less than the coefficient of friction of the drive roller 13 and restraint roller 15 to paper 3.

Other variation and alternatives employing this invention are clearly available.

I claim:

1. Sheet separating and feeding apparatus comprising a driven roller and a restraint roller mounted to be in nip contact, a gear train which comprises a driven gear which drives said driven roller and a driving gear, a bracket mounting said driven roller and said gear train, said bracket being mounted to pivot around said driving gear, a bin positioned to hold sheets for feeding said sheets to said nip, drive means to move sheets from said bin to said nip, sheet feed means located past said nip to begin feeding a sheet which is in said nip, the rotation of said driving gear being in a direction to rotate said bracket toward said nip and said gear train translating said rotation of said driving gear to rotation of said driven roller so that said driven roller moves paper from said nip to said paper feed means located past said nip, the coefficient of friction of said driven roller and said restraint roller each being greater than the coefficient of friction of paper to paper in a stack and said sheet feed means past said nip moving said sheets faster than said driven roller is moving said sheets.

2. The sheet separator as in claim 1 in which said sheets are sheets of paper.

* * * * *